US006944098B2

(12) United States Patent
Rochat et al.

(10) Patent No.: US 6,944,098 B2
(45) Date of Patent: Sep. 13, 2005

(54) TIMEPIECE INCLUDING TWO CASES ABLE TO PIVOT WITH RESPECT TO EACH OTHER

(75) Inventors: Marco Rochat, Le Brassus (CH); Vincent Laucella, Le Brassus (CH)

(73) Assignee: Montres Breguet SA (CH)

( * ) Notice: Subject to any disclaimer, the term of this patent is extended or adjusted under 35 U.S.C. 154(b) by 0 days.

(21) Appl. No.: 10/934,725

(22) Filed: Sep. 7, 2004

(65) Prior Publication Data

US 2005/0052955 A1 Mar. 10, 2005

(30) Foreign Application Priority Data

Sep. 8, 2003 (EP) ..... 03077820

(51) Int. Cl.[7] ..... G04B 37/00; G04B 19/00; G04C 17/00

(52) U.S. Cl. ..... 368/88; 368/223; 368/276; 368/281

(58) Field of Search ..... 368/76, 80, 88, 368/223, 228, 276, 281

(56) References Cited

U.S. PATENT DOCUMENTS

| | | | | |
|---|---|---|---|---|
| 3,293,846 A | | 12/1966 | Pauli | |
| 4,236,239 A | | 11/1980 | Imgruth et al. | |
| 4,444,513 A | | 4/1984 | Proellochs et al. | |
| 4,903,250 A | * | 2/1990 | Cho | 368/41 |
| 4,941,137 A | * | 7/1990 | Kikuchi | 368/223 |
| 5,161,130 A | * | 11/1992 | Sato et al. | 368/228 |
| D352,469 S | | 11/1994 | Schlup | |
| 5,384,756 A | * | 1/1995 | Pelosi | 368/281 |
| 5,479,381 A | | 12/1995 | Goldenberg et al. | |
| 6,515,942 B2 | * | 2/2003 | Basturk | 368/223 |
| 6,618,328 B1 | * | 9/2003 | Ellner et al. | 368/88 |

FOREIGN PATENT DOCUMENTS

| | | |
|---|---|---|
| CH | 655 633 A3 | 5/1986 |
| CH | 580 329 A3 | 8/1992 |
| DE | 43 22 471 A1 | 1/1995 |
| EP | 1 070 997 A1 | 7/1999 |
| EP | 1 189 117 A1 | 9/2000 |
| EP | 1 189 118 A1 | 9/2000 |
| WO | WO 01 07970 A1 | 2/2001 |

* cited by examiner

*Primary Examiner*—Vit W. Miska
(74) *Attorney, Agent, or Firm*—Sughrue Mion, PLLC

(57) ABSTRACT

The timepiece comprises a body forming a case inside which is accommodated a clockwork-movement. This body comprises an upper case (1), which has a front face having first display means (16), and a lower case (2), which has a front face having second display means (26). One of the cases is mounted pivoting on the other about a pivoting axis (X) substantially perpendicular to the general plane of the cases and can occupy a closed position, in which the upper case is superposed on the lower case, and an open position, in which the upper case has pivoted sideways and lets the second display means (26) be seen. The clockwork-movement comprises respective portions (100, 200), accommodated in the upper and lower cases to drive the first and second display means, and a drive mechanism (5) ensuring a kinematic link between the two portions of the clockwork-movement. This kinematic link is interrupted when the cases are put in the open position.

13 Claims, 3 Drawing Sheets

A-A

TIMEPIECE INCLUDING TWO CASES ABLE TO PIVOT WITH RESPECT TO EACH OTHER

This application claims priority from European Patent Application No. 03077820.3 filed Sep. 8, 2003, the entire disclosure of which is incorporated herein by reference.

TECHNOLOGICAL BACKGROUND

The present invention relates to a timepiece comprising a body forming a case inside which is accommodated a clockwork-movement, said body having at least two separate faces on which are respectively disposed first and second display means driven by the clockwork-movement.

Timepieces corresponding to the above general definition are already known. The documents U.S. Pat. Nos. 4,236,239, 4,493,561, U.S. Des 352 469, DE 43 22 471, U.S. Pat. No. 5,479,381, EP 1 070 997, WO 01/07970, EP 1 189 117 or EP 1 189 118 describe for example solutions in which the first and second display means are disposed on two opposite faces of the same body forming a case, this body being capable of being formed by a single case or by two independent half-cases which are immovably attached the one to the other. These solutions entail turning over the body forming the case in order to uncover alternatively the first or second display means and sometimes require more or less complex mechanisms to permit this turning-over, just like the solutions described in the documents U.S. Pat. Nos. 4,236,239, 4,493,561, U.S. Des 352 469, DE 43 22 471, EP 1 189 117 or EP 1 189 118. The solutions described in the documents U.S. Pat. No. 5,479,381, EP 1 070 997 and WO 01/07970 are structurally simpler insofar as it is sufficient to turn the timepiece over in its entirety, this entailing the use of a reversible strap in the case of an application as a wrist-watch.

Solutions in which the body forming the case is made up of two articulated cases or half-cases are also known, for example from the documents CH 680 329 or U.S. Pat. No. 4,444,513. Finally, solutions employing two separate cases are also known as the document U.S. Pat. No. 3,293,846 shows. These configurations necessarily entail each case including its own clockwork-movement.

A disadvantage common to all the above-mentioned solutions lies in the fact that the two display means cannot be visible simultaneously. Certain of the envisaged configurations entail moreover the presence of two separate clockwork-movements to drive the display means.

To complete the explanation of the prior art, one can also cite the document CH 655 633 which presents a timepiece comprising first and second cases (an upper case and a lower case) mounted pivoting with respect to each other about a pivoting axis substantially perpendicular to the general plane of the cases. The two cases can occupy a first closed position in which the upper case is superposed on the lower case and masks the front face of the lower case, and a second open position in which the upper case is pivoted relative to the lower case in order to uncover the front face of the latter. However this is a timepiece in which the upper case includes a clockwork-movement and associated means for displaying the time and in which the lower case comprises a compass. It will be understood that the clockwork-movement is integrally mounted in the upper case and is totally independent of the mechanism accommodated in the lower case, i.e. the compass.

SUMMARY OF THE INVENTION

A general aim of the present invention is to propose a solution which permits, just like prior solutions, the exploitation of a larger surface on the timepiece in order to equip it with a vast range of display means whilst nevertheless ensuring a great simplicity of manipulation, in particular avoiding the necessity of turning over the body forming the case.

Another aim of the present invention is to propose a solution which only requires a single clockwork-movement and which may moreover be realised entirely in mechanical form.

To this end, the object of the present invention is a timepiece wherein the body forming the case of the timepiece comprises a first case, termed upper case, which has a front face comprising the first display means and a second case, termed lower case, which has a front face comprising the second display means. These cases are pivotally mounted with respect to each other about a pivoting axis substantially perpendicular to the general plane of the cases and can occupy a first position, termed closed, in which the upper case is superposed on the lower case and masks at least partially the front face of the lower case, and a second position, termed open, in which the lower case is pivoted sideways relative to the lower case to uncover at least a portion of the front face of the latter. The clockwork-movement comprises first and second portions accommodated respectively in the upper and lower cases to drive the first and second display means, respectively, and a drive mechanism ensuring a kinematic link between the first and second portions of the clockwork-movement when the cases are brought into the open position.

In that way, a timepiece is proposed which makes it possible to mask and uncover additional display means disposed on the front face of the lower case, these manipulations being simply effected by rotating the upper case about the pivoting axis. This constitutes a particularly elegant solution which does not require the case to be turned over as is the case in the solutions of the prior art.

The clockwork-movement is subdivided into two portions which are respectively accommodated in the upper and lower cases, the drive mechanism being provided to ensure a kinematic link between these two portions of the clockwork-movement and to interrupt this kinematic link when the cases are brought into the open position. According to a particularly advantageous embodiment, the drive mechanism includes a moving transmission part which has an axis merged with the pivoting axis of the cases, this moving transmission part comprising a first end located in the upper case and a second end located in the lower case. According to this embodiment, the cases are brought into the open position by rotating the upper case relative to the lower case in a first specific direction of rotation and the moving transmission part is driven in rotation by the clockwork-movement in a second direction of rotation, which is opposite from the first direction of rotation, the drive mechanism being arranged to interrupt the driving in rotation of the moving transmission part when the cases are brought into the open position and to re-establish the driving in rotation of the moving transmission part when the cases are brought into the closed position.

According to a preferred variant of this embodiment, the drive mechanism is also arranged to make up for an error in synchronism (or delay) between the first and second display means when the cases are brought into the closed position. According to one embodiment, the timepiece also includes an essentially tubular retention element having an axis merged with the pivoting axis of the cases and crossed by the above-mentioned moving transmission part, this retention element being immovably attached to one of the cases and holding the other case axially along said pivoting axis whilst permitting a rotation of this other case relative to the retention element.

BRIEF DESCRIPTION OF THE DRAWINGS

Other features and advantages of the present invention will appear more clearly in reading the following detailed description of embodiments of the invention which are presented solely by way of non-restrictive examples and illustrated by the attached drawings in which.

DESCRIPTION OF EMBODIMENTS OF THE INVENTION

Figure 1B:
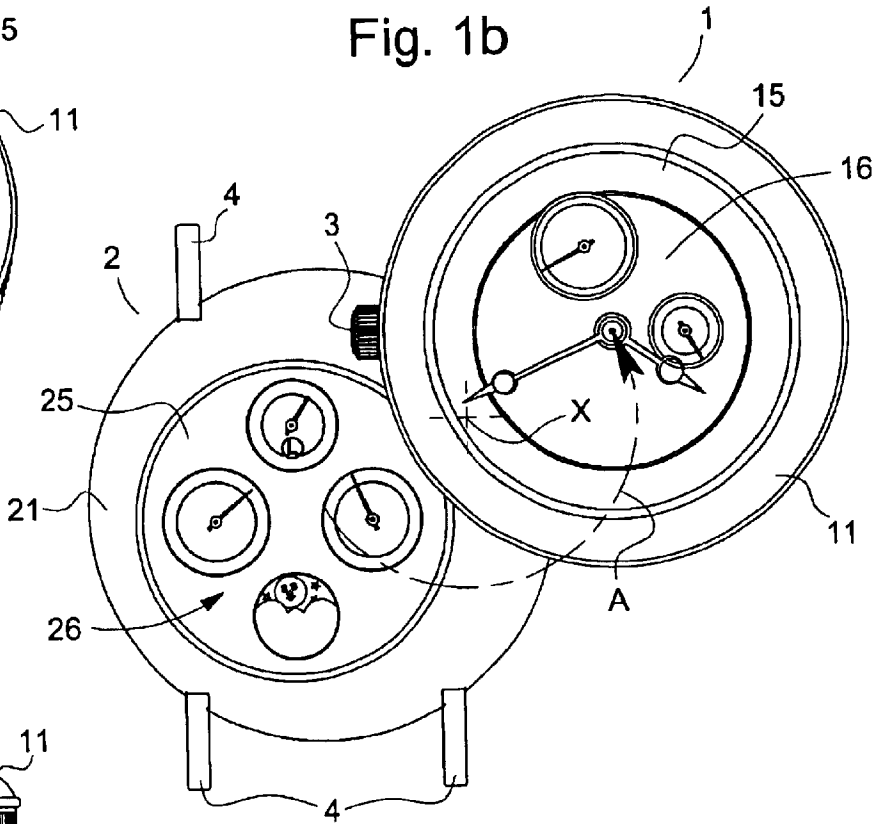
FIGS. 1*a*, 1*b* and 1*c* are respectively views in perspective, from above and from the side of an embodiment of the invention in which the two cases are illustrated in the open position.
Figure 1A:
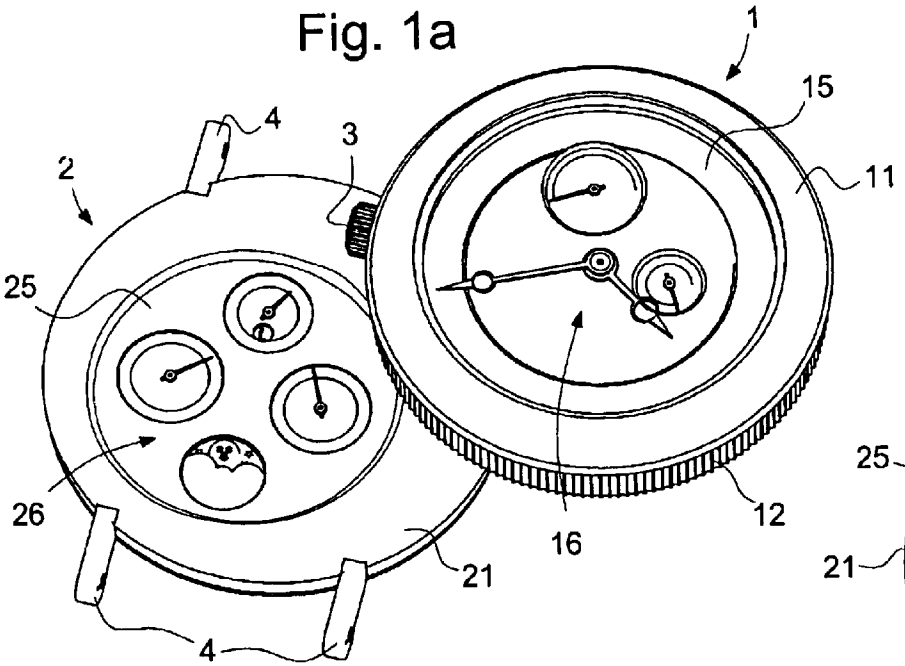
Figure 1C:
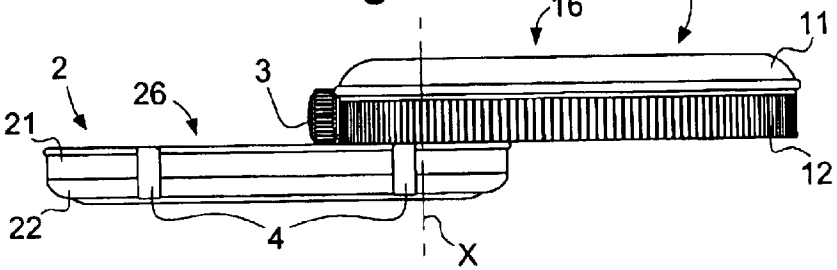

FIGS. 1*a* to 1*c* illustrate overall a timepiece which is in the general form of a wrist-watch and constitutes a preferred embodiment of the present invention. It can be seen in these figures that the body forming the case of the timepiece is made up of two cases 1 and 2, designated respectively the upper case and the lower case, each bearing on their front face display means which are designated overall by the numbers 16 and 26 respectively. These two cases 1, 2 are capable of pivoting with respect to each other about a pivoting axis, designated X, substantially perpendicular to the general plane of the two cases 1 and 2. In that way, the upper 1 and lower 2 cases can occupy a first position, termed closed (not shown), in which the upper case 1 is superposed on the lower case 2 and masks the front face of this case, and a second position, termed open (position represented in FIGS. 1*a* to 1*c*) in which the upper case 1 is pivoted relative to the lower case 2 in order to uncover at least a portion of the front face where the second display means 26 are located.

In the embodiment which is illustrated, it will be noted that the lower case 2 is classically fitted with horns 4 to permit the attachment of a wristlet strap, not shown. The upper case 1, for its part, is classically provided with a rod-crown 3 to permit the timepiece to be set to the time. The first display means 16 provided on the front face of the upper case 1 (under a watch-glass designated by the reference numeral 15) classically include hour and minute hands disposed in the centre and supplemented by other indicators, for example a seconds' indicator or a power reserve indicator. For their part, the second display means 26 provided on the front face of the lower case 2 (under a second watch-glass designated by the reference numeral 25) include especially an indicator of the phases of the moon and an indicator of the days of the month. These second display means 26 are disposed altogether in an off-centre position on the front face of the lower case 2.

The illustrated distribution of the various indicators on the two cases 1, 2 is obviously not restrictive and could be quite different; the hour and minute hands could for example be disposed on the front face of the lower case 2. Typically these hands will be disposed on the case in which are accommodated the source of mechanical energy (spring barrel and its spring) and the members for regulating the working of the timepiece (balance-hairspring and escapement); these members can be disposed independently in the upper 1 or lower 2 case. In the embodiments illustrated in the figures it will be understood that the presence of the rod-crown 3 and hour and minute hands on the upper case 1 suggests that these members are disposed in the upper case 1.

Within the framework of the present invention, it ought to be mentioned that the clockwork-movement is strictly speaking subdivided into two portions (not represented in FIGS. 1*a* to 1*c*) which are accommodated respectively in the upper 1 and lower 2 cases (these portions are hereinafter designated overall by the reference numerals 100 and 200 respectively), a drive mechanism being provided to ensure a kinematic link between these two portions of the movement. This drive mechanism will be described in greater detail in the later part of the present description.

With regard to the disposition of the pivoting point of the two cases 1, 2, this point can be placed a priori at any suitable point of the timepiece. As illustrated in the figures, this pivoting point is advantageously disposed inside the external circumference of the two cases 1, 2, no lug or unsightly protuberance thus being apparent on the periphery of the cases. In the figures it can be seen that the pivoting axis X is situated essentially in the quadrant between twelve o'clock and three o'clock (here substantially at two o'clock), the second display means 26 being moved slightly off-centre towards the lower left-hand portion of the front face of the lower case 2.

Preferably, the cases 1, 2 are brought into the open position by rotating the upper case 1 in a specific direction of rotation about the pivoting axis X. This opening direction is designated in FIG. 1*b* by an arrow bearing the reference A, this opening direction being here anti-clockwise (conventionally this direction of rotation is defined about the pivoting axis X, display means 16, 26 directed towards the front). In the open position, the upper case 1 is pivoted by about 180° relative to its closed position where it is superposed on the lower case 2 to form together a body which has the appearance of a normal watch case. A rotation limitation mechanism is preferably provided to guide the cases 1, 2 and limit their angle of opening.

Figure 2:
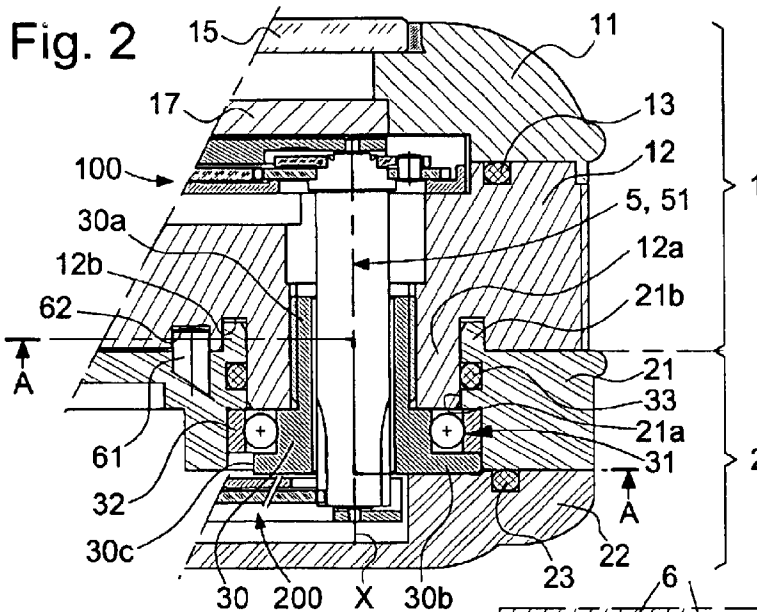
FIG. 2 is a partial sectional view of the timepiece illustrated in FIGS. 1*a* to 1*c*, going through the pivoting axis of the cases.

FIG. 2 shows a partial sectional view going through the pivoting axis of the cases 1, 2 of the timepiece illustrated in FIGS. 1*a* to 1*c*. One can see there the upper case 1, formed by a bezel 11 bearing the watch-glass 15 fitted to a part forming the base 12, and the lower case 2, formed in a similar manner by a bezel 21 bearing the watch-glass 25 (FIG. 1*a*) fitted to a part forming the base 22. FIG. 2 also shows a portion of a dial 17 disposed under the glass 15 and relative to which the hands of the first display means 16 turn. The seal between bezel 11 and base 12, as well as between bezel 21 and base 22 is ensured in a standard manner by a seal 13 or 23 respectively, disposed in a groove provided on the base 12 or 22 respectively.

The base 12 of the upper case 1 and the bezel 21 of the lower case 2 include an opening arranged to permit the passage of the drive mechanism ensuring the kinematic link between the two portions 100, 200 of the clockwork-movement. This drive mechanism is designated overall by the number 5 and is illustrated in more detail in FIGS. 4*a* and 4*b* which will be discussed below. According to the embodiment illustrated, it will be already noted that the drive mechanism 5 includes especially a moving transmission part 51, one end of which emerges in the upper case 1 and another end of which emerges in the lower case 2.

The pivoting and the mechanical link between the upper 1 and lower 2 cases are preferably ensured by means of a tubular retention element 30, the axis of which is merged with the pivoting axis X of the cases 1, 2 and through which the moving transmission part 51 passes. This retention element 30 is attached immovably to one of the cases (here the upper case 1), for example by means of screwing, as illustrated, or by any other appropriate means. In this example, the retention element 30 thus includes a threaded end 30*a* cooperating with an inside thread provided in the base 12 of the upper case 1. The lower case 2 is retained axially along the pivoting axis X by means of a bearing surface 30*b* provided on the other end of element 30. In this particular case, the bezel 21 of the lower case 2 is retained axially between the bearing surface 30*b* and the base 12 of the upper case 1.

In the example of FIG. 2, the retention element 30 advantageously forms the inner raceway of a ball bearing 31, the outer ring of which is immovably attached to the lower case 2. It will be understood that this configuration makes it possible to reduce the friction between the contact zones of the two cases during the operations of opening and closing these two cases. By way of alternative, as illustrated in FIG. 3, it is perfectly conceivable not to make use of a ball bearing and to provide directly radial play between the retention element 30 and the lower case 2.

It will be understood that the retention element 30 could alternatively be attached immovably to the lower case 2 and that the pivoting of the two cases could be ensured by rotation between the retention element 30 and the upper case 1.

Figure 3:
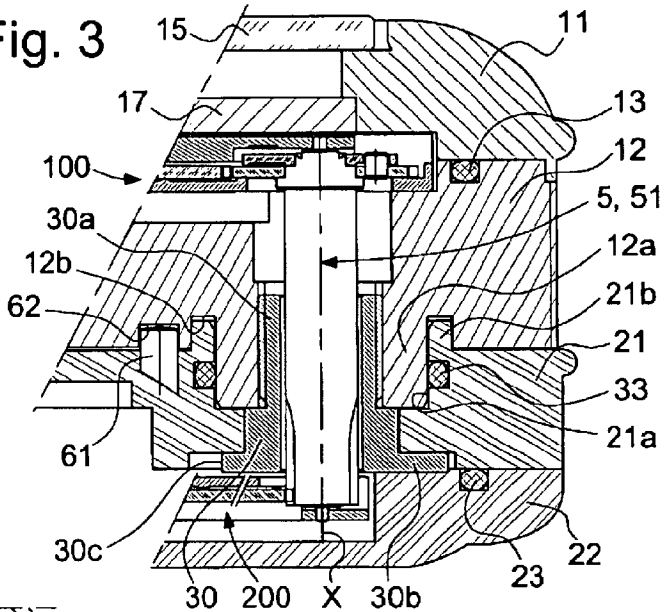
FIG. 3 is a partial sectional view similar to FIG. 2, illustrating a variant embodiment.

From a mechanical viewpoint and from the viewpoint of a tight seal at the level of the pivoting axis X, it is preferable, as illustrated in FIGS. 2 and 3, to provide on one of the cases at least one annular protuberance cooperating with an aperture or annular groove of corresponding diameter on the other case. In the examples of FIGS. 2 and 3, the base 12 of the upper case 1 is thus provided with such a protuberance designated by the reference numeral 12*a* and cooperating with a corresponding aperture, designated 21*a*, provided in the bezel 21 of the lower case 2. In FIG. 2, the bezel 21 is also provided with an annular protuberance 21*b* which becomes lodged in a corresponding annular groove 12*b* provided in the base 12.

The tight seal between the two cases 1 and 2 is ensured by a sealing ring 33 inserted radially between the protuberance 12*a* and the wall of the aperture 21*a*. This sealing ring 33 is in this case disposed in a groove provided in the wall of the aperture 21*a*. It is obvious that the sealing ring 33 could alternatively be accommodated in a groove provided around the protuberance 12*a*.

Figure 2A:
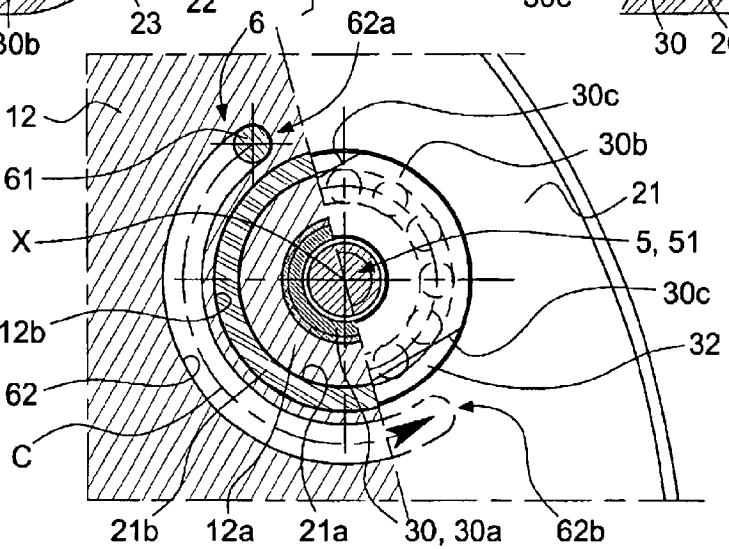
FIG. 2*a* is a bottom view, in partial section, taken perpendicularly to the pivoting axis of the cases, along the cutting line A—A shown on FIG. 2.

FIG. 2*a* is a partial sectional view of the timepiece, along cutting planes which are generally perpendicular to the pivoting axis X, along the cutting line A—A shown on FIG. 2. One can see there the base 12 of the upper case 1 and the bezel 21 of the lower case 2 as well as the annular protuberances 12*a* and 21*b* provided respectively on base 12 and bezel 21. One can also see in this figure, in section, the retention element 30 and its threaded end 30*a*, attached immovably to the base 12 by means of screwing, as well as the moving transmission part 51 of the drive mechanism 5. Finally, the ball bearing with its outer ring 32 can be seen there.

In FIG. 2*a* it is also possible to see that the base of the retention element 30, in which the bearing surface 30*b* is provided, advantageously includes two diametrically opposite flattened portions 30*c*, the purpose of which is to permit and facilitate the screwing of the retention element 30 into the base 12 of the upper case 1, this screwing operation being carried out here before the base 22 of the lower case 2 is mounted.

In FIG. 2*a* can be seen, finally, the rotation limitation mechanism already mentioned above, which is given overall the reference numeral 6. This limitation mechanism 6 ensures, firstly, that the cases 1, 2 can only be brought into the open position by rotation of the upper case 1 in a single direction of rotation, here anti-clockwise. This limitation mechanism ensures, secondly, a specific angle of opening, here chosen to correspond substantially to 180°. In the example of FIG. 2*a* it can be seen that the rotation limitation mechanism 6 includes a banking pin 61, here attached immovably to the bezel 21 of the lower case 2 and which cooperates with a groove 62 provided in the base 12 of the upper case 1. This banking pin 61 and this groove 62 are partially shown on FIGS. 2 and 3. It will be understood that in the closed position, the pin 61 is stopped against a first end 62*a* of the groove and that in the open position, this pin 61 is stopped by the other end 62*b* of the groove 62, the pin 61 thus undergoing a displacement in the groove 62 as indicated by arrow C. By way of alternative, it is again very obvious that the banking pin 61 can be attached immovably to the base 12 and that a groove can be provided in the bezel 21. Other rotation limitation mechanisms can also be envisaged.

Figure 4B:
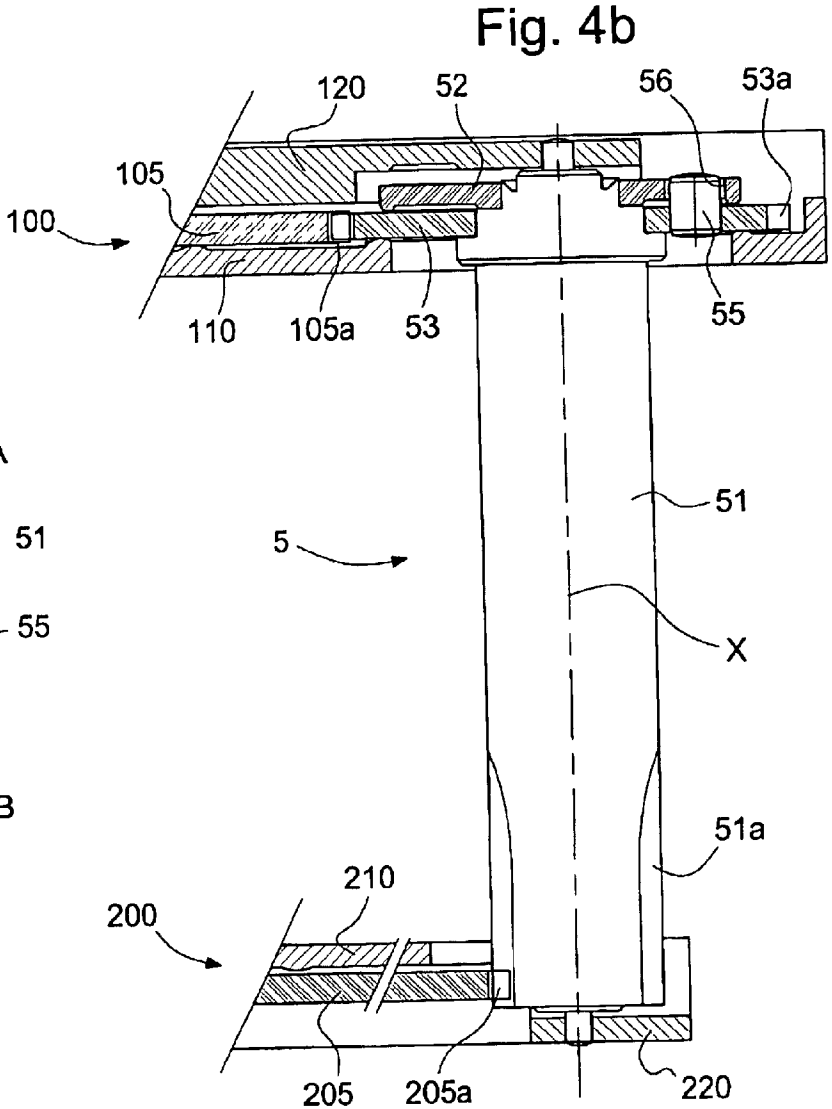
FIGS. 4*a* and 4*b* are respectively plan and sectional views giving details more especially of a preferred embodiment of the drive mechanism which ensures the kinematic link between the two portions of the movement.
Figure 4A:
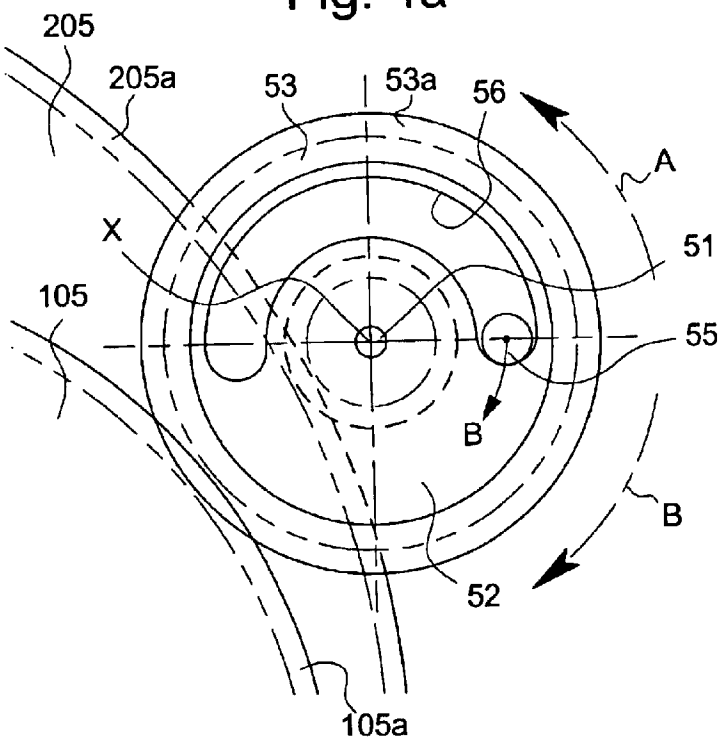

FIGS. 4*a* and 4*b* will now make it possible to describe in detail the configuration and functioning of the drive mechanism 5. On these figures it will be noted that the elements which do not participate directly in the functioning of the drive mechanism 5 have not been illustrated for the sake of simplification. In FIGS. 4*a* and 4*b* can be found on the other hand the moving transmission part 51 already mentioned, the axis of rotation of which is merged with the pivoting axis X of the cases 1, 2. In FIG. 4*a* has also been indicated by arrow A the direction of rotation followed by the upper case 1 during opening (conventionally, it will be considered that the opening is carried out when the display means 16, 26 face the observer) and by arrow B the normal direction of rotation of the moving transmission part 51 when the latter is driven by the clockwork-movement.

In addition to the moving transmission part 51 which emerges in each of the cases 1, 2, the drive mechanism 5 includes moreover a driving wheel 53, a plate 52 as well as linkage means 55, 56 inserted between the driving wheel 53 and the plate 52. The driving wheel 53 and the plate 52 are mounted coaxially with the moving transmission part 51 and are disposed with the linkage means 55, 56 on an end of the moving transmission part 51, here situated in the upper case 1. The other end of the moving transmission part 51 is situated in the lower case 2.

As can be seen diagrammatically in FIG. 4*b*, the moving transmission part 51 is mounted between a bridge 120 of the first portion 100 of the movement located in the upper case 1 and a bridge 220 of the second portion 200 of the movement located in the lower case 2. The reference numerals 110 and 210 designate additional bridges or bottom plates of the two portions 100 and 200 of the movement.

Plate 52 is immovably attached to the moving transmission part 51 whilst the driving wheel 53 is mounted rotating freely around the moving transmission part 51. It can be seen here that the driving wheel 53 is retained axially between the plate 52 and a bearing surface (not given a reference) provided on the moving transmission part 51.

The driving wheel 53 engages permanently with the first portion 100 of the clockwork-movement accommodated in the upper case 1. In FIGS. 4*a* and 4*b* has been illustrated solely a driving wheel 105 forming part of the first portion 100 of the clockwork-movement with its teeth 105*a* engaging with the teeth 53*a* of the driving wheel 53. It will be understood then that the driving wheel 53 is continually driven in rotation under the effect of the first portion 100 of the clockwork-movement, the driving of this wheel 53 taking place in the direction of arrow B. At the other end of the drive mechanism 5, in the lower case 2, the moving transmission part 51 engages directly with the second portion 200 of the clockwork-movement. In particular, the moving transmission part 51 is terminated by a portion forming a pinion 51*a* which engages directly with the teeth 205*a* of a wheel 205 forming part of the second portion 200 of the clockwork-movement, situated in the lower case 2.

The linkage means 55, 56 between the plate 52 and the driving wheel 53 are arranged in such a way that the plate 52 is normally driven in rotation by means of the driving wheel 53 when the cases 1, 2 occupy the closed position and in such a way that the driving in rotation of the plate 52 by the driving wheel 53 is interrupted when the cases are brought into the open position. A number of solutions can be envisaged for fulfilling this function. A particularly simple and advantageous solution is illustrated in the drawings.

In FIGS. 4*a* and 4*b* it can thus be seen that the driving wheel 53 bears a pin 55, disposed in an off-centre position relative to the pivoting axis X and one end of which is slindingly engaged in a groove 56 which is provided in the plate 52 and has the outline of an arc of a circle. It will be understood that the pin 55 could alternatively be placed on the plate 52 and the groove 56 could provided on the driving wheel 53. In all cases, the driving in rotation of the plate 52 by the driving wheel 53 is ensured by the pin 55 being stopped against one end of the groove 56, as is clearly illustrated in FIG. 4*a*. When the cases 1, 2 are brought into the open position, the pin 55 undergoes a displacement in the groove 56, thus interrupting the stopping of the pin 55 against the end of the groove 56.

In the closed position, when the two cases are superposed, it will thus be understood that the driving wheel 53 drives in rotation the plate 52 and the moving transmission part 51, thus ensuring the kinematic link between the first portion 100 and the second portion 200 of the movement. As soon as the upper case 1 begins to be pivoted relative to the lower case 2 in the direction of rotation indicated by arrow A, the driving of the plate 52 and of the moving transmission part 51 is immediately interrupted, interrupting at the same time the kinematic link between the two portions 100, 200 of the movement. At this moment, it will thus be understood that the synchronism between the two portions of the movement, and thus also between the first and second display means 16, 26, is interrupted and the second display means 26 can go slow in relation to the first display means 16.

In the open position, the driving wheel 53 is however always driven in rotation by the first portion 100 of the movement. The pin 55 will thus move in the groove 56 in the direction of the end of the groove 56 against which this pin was previously stopped. After a certain lapse of time which depends on the speed of rotation of the driving wheel 53 and on the dimensions of the groove 56, the pin 55 will again reach a position where it is stopped against the end of the groove 56. As long as the cases 1, 2 remain in the open position, an error in the synchronism between the display means 16, 26 will thus be generated, this error increasing in the course of time to reach a specific value as soon as the pin 55 is brought again into a position where it is stopped against the end of the groove 56.

This error in synchronism (or delay) is however totally compensated and made up for during the closing of the cases 1, 2. Indeed, during the closing of the cases 1, 2 (by rotating the upper case 1 in an opposite direction from the opening direction), the pin 55 is again brought into a position where it is stopped against the end of the groove 56 (if that was not already the case). At the same time, the plate 52 and the moving drive part 51 undergo an angular displacement in the direction of arrow B which corresponds to the angular displacement of the pin 55 in the groove 56 (in the direction of arrow B) since the kinematic link has been interrupted, i.e. since the opening of the cases 1, 2.

During the opening and closing of the cases, the pin 55 undergoes an angular displacement corresponding to the angle of opening of the cases, in one direction then in the other. The opening and closing operations do not therefore in the end generate any delay or loss of synchronism between the first and second display means 16 and 26. The delay is due solely to the time which has elapsed since the interruption of the kinematic link and this delay is totally caught up during the closing operation as a result of the relative angular displacement of the pin 55 in relation to the groove 56. At maximum, the plate 52 and the moving transmission part 51 will undergo during the closing operation a forced angular displacement which is equivalent to the angle of opening of the cases, i.e. 180° in this example.

It will be understood that the dimensions of the groove 56 are chosen to permit the pin to move during the opening of the cases without coming into contact with the other end of the groove 56. In other words, the groove 56 has an angle of development which is greater than the opening angle of the cases 1, 2. In the contrary case, the plate 52 and the moving transmission part 51 will be partially driven during the opening of the cases in a direction of rotation which is the opposite of their normal direction of rotation, which is not to be recommended. In this particular case, therefore, the angle of development of the groove 56 is slightly greater than the opening angle of the cases which is here fixed at 180°.

It will be noted that the maximum duration of the interruption of the kinematic link between the two portions 100, 200 of the movement depends on the dimensions of the moving parts of the movement and of the drive mechanism 5 and can be fixed as desired to several minutes or several hours. It ought to be mentioned that the forced angular displacement as well as the stresses caused on the teeth of the moving parts during the closing operation do not constitute a real problem.

It will be understood in a-general way that various modifications and/or improvements obvious to the person skilled in the art can be made to the embodiments described in the present description without departing from the scope of the invention defined by the attached claims. Thus a certain number of the mechanical solutions described, in particular for the mechanical retention of the two cases, for the limitation of the opening angle of the cases and for the realisation of the function of disengaging the drive mechanism may be replaced by any other mechanical solution which is functionally equivalent. It seems perfectly conceivable, for example, to have recourse to solutions of the type involving a pallet to realise the function of disengaging the drive wheel. The described solutions appear preferable, however, as much from the point of view of their simplicity as of their robustness.

What is claimed is:

1. A timepiece comprising a body forming a case inside which is accommodated a clockwork-movement, said body having at least two separate faces on which are respectively disposed first and second display means driven by said clockwork-movement, wherein said body forming a case comprises an upper case, which has a front face having said first display means and a lower case, which has a front face having said second display means, said cases being pivotally mounted with respect to each other around a pivoting axis which is substantially perpendicular to the general plane of said cases and able to occupy a first position, termed closed, in which the upper case is superposed on said lower case and masks at least partially the front face of the lower case, and a second position, termed open, in which the upper case is pivoted relative to the lower case in order to uncover at least a portion of the front face of the latter, said clockwork-movement comprising first and second portions accommodated respectively in the upper and lower cases to drive said first and second display means, respectively, and a drive mechanism ensuring a kinematic link between the first and second portions of the clockwork-movement.

2. The timepiece according to claim 1, wherein said drive mechanism is arranged to ensure an interruption of the kinematic link between the first and second portions of the clockwork-movement when said cases are put in said open position.

3. The timepiece according to claim 1, wherein said drive mechanism includes a moving transmission part which has an axis merged with said pivoting axis of the cases, said moving transmission part comprising a first end located in said upper case and a second end located in said lower case, and wherein said timepiece also includes an essentially tubular retention element having an axis merged with said pivoting axis and crossed by said moving transmission part, said retention element being immovably attached to one of said cases and holding the other case axially along said pivoting axis whilst permitting a rotation of said other case relative to the retention element.

4. The timepiece according to claim 3, wherein said retention element is attached immovably to one of said cases by means of screwing.

5. The timepiece according to claim 3, wherein said retention element forms or bears an inner raceway of a ball bearing.

6. The timepiece according to claim 3, wherein one of said cases has an annular projection, centered on said pivoting axis and crossed by said moving transmission part, said projection being engaged in a corresponding aperture provided on the other of said cases, and wherein a seal is disposed between said projection and said aperture.

7. The timepiece according to claim 2, wherein said drive mechanism includes a moving transmission part which has an axis of rotation merged with said pivoting axis, said moving transmission part comprising a first end located in said upper case and a second end located in said lower case, wherein said cases are brought into the open position by rotating said upper case relative to said lower case in a first direction of rotation, and wherein said moving transmission part is driven in rotation by the clockwork-movement in a second direction of rotation which is opposite from the first, said drive mechanism being arranged to interrupt the driving in rotation of said moving transmission part when said cases are placed in the open position and to re-establish the driving in rotation of said moving transmission part when said cases are brought into the closed position.

8. The timepiece according to claim 7, wherein said drive mechanism is also arranged to make up for an error in synchronism between said first and second display means when said cases are brought into the closed position.

9. The timepiece according to claim 8, wherein said drive mechanism also includes, mounted coaxially with said moving transmission part:

a driving wheel mounted freely rotating on said moving transmission part, engaging with said first portion of the clockwork-movement and driven in rotation in said second direction of rotation; and a plate which is immovably attached to said moving transmission part and capable of being driven in rotation by said driving wheel in said second direction of rotation, said moving transmission part engaging via its second end with said second portion of the clockwork-movement, said driving wheel and said plate being mechanically interlinked by linkage means which are arranged in such a way that said plate is normally driven in rotation by means of said driving wheel when said cases occupy said first closed position, and in such a way that the driving in rotation of said plate by said driving wheel is interrupted when said cases are placed in the open position.

10. The timepiece according to claim 9, wherein said linkage means include a pin which is immovably attached to said driving wheel or said plate, disposed in an off-centre position relative to said pivoting axis and one end of which is engaged in a groove provided in said plate or in said driving wheel, respectively, and having an arcuate shape, the driving in rotation of said plate by the driving wheel being ensured by stopping said pin against an end of said groove, said pin undergoing a displacement in said groove when said cases are brought into the open position, thus interrupting the stopping of the pin against said end of the groove.

11. The timepiece according to claim 1, wherein it also includes a rotation limitation mechanism for limiting the angle of opening of said cases to a specific value, preferably 180°.

12. The timepiece according to claim 1, wherein the pivoting axis of the cases is located between twelve o'clock and three o'clock.

13. The timepiece according to claim 1, forming a wristwatch.

* * * * *